US006644295B2

(12) United States Patent
Jones

(10) Patent No.: US 6,644,295 B2
(45) Date of Patent: Nov. 11, 2003

(54) PNEUMATIC ASSEMBLY FOR A PAINTBALL GUN

(75) Inventor: Danial Jones, Waterford, MI (US)

(73) Assignee: Smart Parts, Inc.

( * ) Notice: Subject to any disclaimer, the term of this patent is extended or adjusted under 35 U.S.C. 154(b) by 0 days.

(21) Appl. No.: 10/114,915

(22) Filed: Apr. 1, 2002

(65) Prior Publication Data

US 2003/0005918 A1 Jan. 9, 2003

Related U.S. Application Data

(60) Provisional application No. 60/302,821, filed on Jul. 3, 2001.

(51) Int. Cl.[7] ..... F41B 11/32

(52) U.S. Cl. ..... 124/77; 124/73; 124/75

(58) Field of Search ..... 124/77, 73, 74, 124/76, 71, 70, 72, 75

(56) References Cited

U.S. PATENT DOCUMENTS

| | | | | |
|---|---|---|---|---|
| 2,304,320 A | | 12/1942 | Tratsch | 124/11 |
| 2,554,116 A | | 5/1951 | Monner | 124/11 |
| 2,568,432 A | | 9/1951 | Cook | 124/13 |
| 2,594,240 A | | 4/1952 | Wells | 124/13 |
| 2,634,717 A | | 4/1953 | Junkin | 124/11 |
| 2,834,332 A | | 5/1958 | Guthrie | 124/13 |
| 2,845,055 A | | 7/1958 | Collins et al. | 124/11 |
| 3,089,476 A | | 5/1963 | Wolverton | 124/11 |
| 3,192,915 A | | 7/1965 | Norris et al. | 124/11 |
| 3,662,729 A | | 5/1972 | Henderson | 124/11 |
| 3,695,246 A | | 10/1972 | Filippi et al. | 124/11 |
| 3,921,980 A | | 11/1975 | Artzer | 273/101 |
| 4,094,294 A | | 6/1978 | Speer | 124/56 |
| 4,362,145 A | | 12/1982 | Stelcher | 124/32 |
| 4,770,153 A | | 9/1988 | Edelman | 124/72 |
| 4,819,609 A | | 4/1989 | Tippmann | 124/72 |
| 4,899,717 A | | 2/1990 | Rutten et al. | 124/67 |
| 4,936,282 A | | 6/1990 | Dobbins et al. | 124/74 |
| 5,228,427 A | | 7/1993 | Gardner, Jr. | 124/71 |
| 5,280,778 A | | 1/1994 | Kotsiopoulos | 124/73 |
| 5,285,765 A | | 2/1994 | Lee | 124/50 |
| 5,333,594 A | | 8/1994 | Robinson | 124/73 |
| 5,337,726 A | * | 8/1994 | Wood | 124/61 |
| 5,349,938 A | * | 9/1994 | Farrell | 124/73 |
| 5,383,442 A | | 1/1995 | Tippmann | 124/76 |
| 5,413,083 A | | 5/1995 | Jones | 124/32 |

(List continued on next page.)

FOREIGN PATENT DOCUMENTS

GB 2313655 A * 12/1997 ..... F41B/11/32

OTHER PUBLICATIONS

Matrix–Main Body Assembly & Parts Listing at http://www.directpaintball.com/pics/diablomatrix/matrixparts.gif. 3 pages.

Techno Paintball—information reviews articles forum auction and chat at http://www.technopaintball.com/matrixreview.htm 2pages.

*Primary Examiner*—Charles T. Jordan
*Assistant Examiner*—John W. Zerr
(74) *Attorney, Agent, or Firm*—Marger Johnson & McCollom, P.C.

(57) ABSTRACT

A pneumatic assembly preferably includes a compressed gas storage area, a firing valve, and a bolt arranged along substantially the same horizontal axis. A valve retainer, a compressed gas storage area housing, and a bolt assembly are preferably arranged to form a substantially contiguous assembly housing. The firing valve is preferably configured to open when gas pressure is applied to a surface area thereof through a control valve. The bolt is preferably configured to move to a closed position before the firing valve is actuated. The control valve is preferably an electro-pneumatic valve configured to actuate the firing valve in response to a trigger pull of a paintball gun.

11 Claims, 4 Drawing Sheets

U.S. PATENT DOCUMENTS

| | | | | |
|---|---|---|---|---|
| 5,613,483 | A | 3/1997 | Lukas et al. | 124/73 |
| 5,878,736 | A | 3/1999 | Lotuaco, III | 124/71 |
| 5,881,707 | A | 3/1999 | Gardner, Jr. | 124/77 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,349,711 | B1 * | 2/2002 | Perry et al. | 124/73 |
| 2002/0096164 | A1 * | 7/2002 | Perrone | 124/77 |
| 2002/0170551 | A1 * | 11/2002 | Kotsiopoulos et al. | 124/54 |

* cited by examiner

PNEUMATIC ASSEMBLY FOR A PAINTBALL GUN

This application claims priority from U.S. Provisional Patent Application Serial No. 60/302,821, filed Jul. 3, 2001, the contents of which are hereby incorporated herein by reference in their entirety.

BACKGROUND OF THE INVENTION

This invention relates generally to paintball guns (or "markers"). More specifically, this invention relates to pneumatic paintball guns.

Many pneumatic paintball guns, particularly those fired under electrical control, include large gun bodies. For instance, in U.S. Pat. Nos. 5,881,707; 5,967,133; and 6,035,843, the preferred embodiments include several chambers formed in different areas of the gun body. U.S. Pat. Nos. 5,878,736 and 6,003,504 similarly disclose electronically-operated paintball guns having several chambers formed in various areas of the bodies thereof.

Unfortunately, with many separately formed chambers, typical paintball guns can be bulky and heavy. In the sport of paintball, it is generally desirable to have a gun that is as light and maneuverable as possible. Players need increased mobility to move from bunker to bunker quickly to avoid being hit. Furthermore, in the sport of paintball, the marker is treated as an extension of the body such that a hit to the marker counts as a hit to the player. It is also desirable, therefore, to have a paintball gun with as small a profile as possible.

SUMMARY OF THE INVENTION

One aspect of the present invention is to provide an in-line pneumatic assembly capable of providing the primary operating components of a paintball gun in a single chamber of the paintball gun.

Another aspect of the present invention is to provide a paintball gun that is smaller and lighter than conventional markers.

Yet another aspect of the present invention is to provide a paintball gun that has a smaller profile than conventional paintball guns.

Still another aspect of this invention is to enable a paintball gun having reduced size and weight that fires from a closed-bolt position.

According to one aspect of this invention, an in-line pneumatic assembly includes a gas storage area, a valve, and a bolt. The gas storage area receives compressed gas from a regulated gas supply through a port in the valve. The valve includes two surfaces of different cross-sectional areas. A first surface, having a smaller cross-sectional area, receives a substantially constant supply of compressed gas. A second surface, having a larger cross-sectional area, selectively receives compressed gas to actuate the valve. The bolt is configured to slide back and forth between a forward and a rearward position. The bolt is preferably arranged in a forward (closed) position before the valve is actuated to fire the gun. When the valve is actuated, compressed gas from the compressed gas storage area is directed through the bolt and a paintball is launched from the gun.

According to another aspect of the present invention, a paintball gun includes a body having a breech. An in-line assembly includes a compressed gas storage area, a valve, and a bolt. The valve is preferably configured to close using a force differential between opposing surfaces of the valve and open when pressures on both valve surfaces are equal. The bolt is preferably configured to move to a closed position in the breech before the valve is actuated. The paintball gun also preferably includes a control valve configured to control actuation of the valve in response to a trigger pull.

Other benefits are achieved by having an electro-pneumatic gun. The control valve, for instance, can be an electro-pneumatic valve operated based on electronic signals from a circuit board. The circuit board can be configured to initiate a firing sequence based on a trigger pull. Still further benefits are achieved by having a closed-bolt gun that seats the paintball within the breech before releasing the compressed gas to launch the paintball.

Various other embodiments and configurations are also possible without departing from the principles of the invention disclosed with reference to the foregoing aspects and embodiments. This invention is not limited to any particular embodiment.

BRIEF DESCRIPTION OF THE DRAWINGS

The foregoing objects, features, and advantages of the present invention will become more readily apparent from the following detailed description of preferred embodiments thereof, made with reference to the accompanying figures, in which.

DETAILED DESCRIPTION OF THE PREFERRED EMBODIMENT

Figure 1:
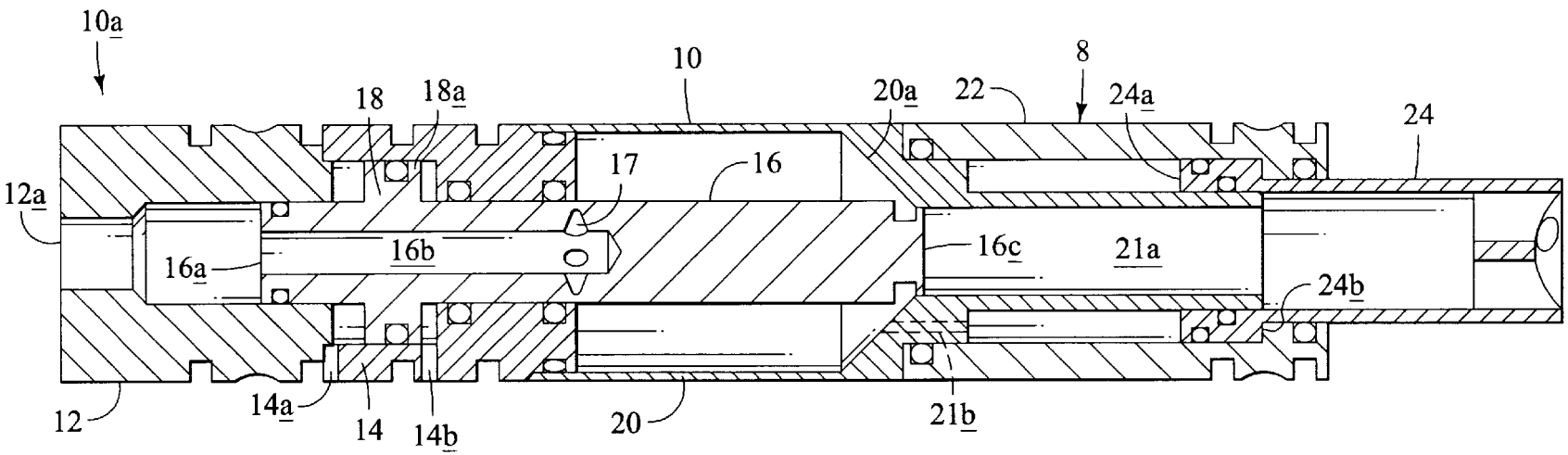
FIG. 1 is a cross-sectional side view of an in-line pneumatic assembly according to one aspect of the present invention.
Figure 2:
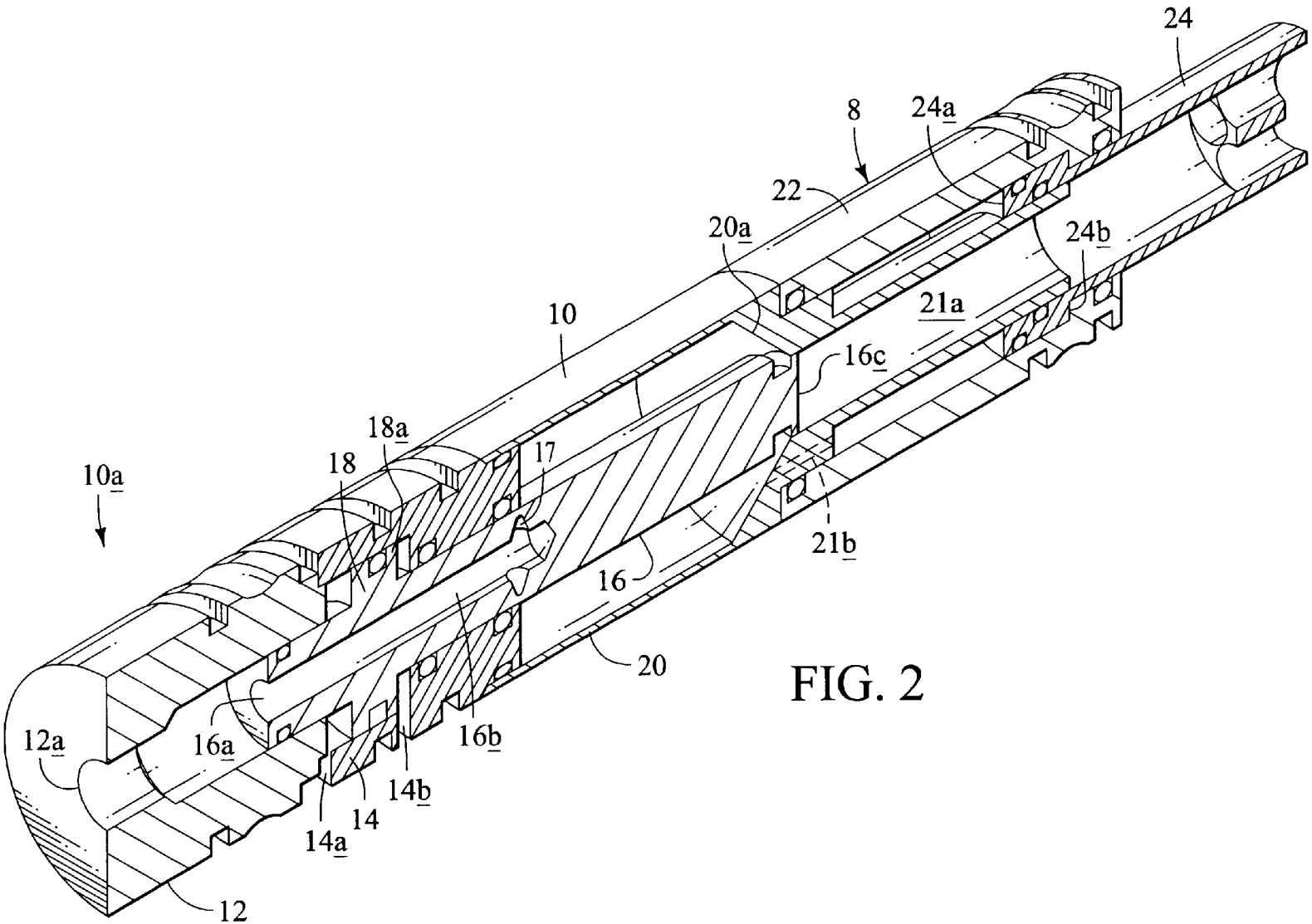
FIG. 2 is a cross-sectional perspective view of the in-line pneumatic assembly of FIG. 1.

The accompanying drawings illustrate the construction of a preferred embodiment of this invention. Referring first to FIGS. 1 and 2, an in-line pneumatic assembly 8 for a paintball gun preferably includes an end cap 12, a valve retainer 14, a firing valve (or valve piston) 16, a compressed gas storage area 20, and a bolt 24 and bolt cylinder 22. The end cap 12, valve retainer 14, compressed gas storage area 20, and bolt cylinder 22 preferably consist of separately molded components that are fitted together end to end to form a contiguous in-line assembly housing. The firing valve 16 is preferably disposed within the end cap 12, valve retainer 14, and compressed gas storage area 20 portions of the in-line assembly housing.

The end cap 12 includes a receiving port 12*a* arranged to receive a regulated supply of compressed gas. A first end 16*a* of the valve piston 16 is located within the end cap 12. The valve piston 16 includes a passageway 16*b* for directing compressed gas from the end cap 12 into the compressed gas storage area 20. An opposite end of the valve piston 16 forms a plug 16*c* that seats within a releasing port 21*a* of the compressed gas storage area 20. When seated, the plug 16*c* prevents the release of compressed gas from the compressed gas storage area 20. The valve piston 16 also includes a first surface area that includes the surface area of the first end 16*a* of the valve 16 and the surface area at the base of the passageway 16*b*. A force created by the pressure of the compressed gas on the first surface area tends to keep the valve piston 16 in a closed position, with the plug 16*c* securely seated in the releasing port.

A valve actuator 18 is located within the valve retainer 14. The valve actuator 18 includes a forward surface 18*a* having a second surface area that is larger than the first surface area of the valve 16. The second surface area is selectively subjected to compressed gas from a control valve through a port in the valve retainer 14 to actuate the valve 16. The compressed gas supplied to the second surface area preferably has the same pressure as the gas supplied to the first surface area. Because of the difference in cross-sectional areas, however, the force exerted on the second surface area is greater than the force exerted on the first surface area, thereby actuating the valve 16. When actuated, the valve 16 is forced rearward, causing the plug 16*c* to become unseated from the releasing port 21*a* of the compressed gas storage area 20. The gas stored in the compressed gas storage area 20 is thereby released into and through the bolt 24.

The bolt 24 is slidably mounted within the bolt cylinder 22 and is capable of movement between a forward and a rearward position. A port 21*b* in the forward end of the compressed gas storage chamber 20 communicates compressed gas with a rearward surface 24*a* of the bolt, causing the bolt 24 to rest in the forward position while the gas storage chamber 20 is pressurized. A forward surface 24*b* of the bolt 24 is preferably configured to selectively receive compressed gas of this same pressure at the time the valve 16 is actuated.

When the valve 16 is actuated, the compressed gas is released from the compressed gas storage area 20, thereby relieving the pressure on the rearward surface 24*a* of the bolt 24. At this same time, pressure is applied to the front end 24*b* of the bolt 24. The pressure on the forward end 24*b* of the bolt 24 therefore causes the bolt 24 to shift to its rearward position. When the valve 16 is deactuated, the plug 16*c* is again seated in the releasing port 21*a* of the gas storage chamber 20, and the pressure therein is allowed to rebuild. The gas applied to the front 24*b* of the bolt 24 is vented at the same time. The pressure applied to the rearward end 24*a* of the bolt 24 therefore causes the bolt 24 to shift forward.

Figure 3:
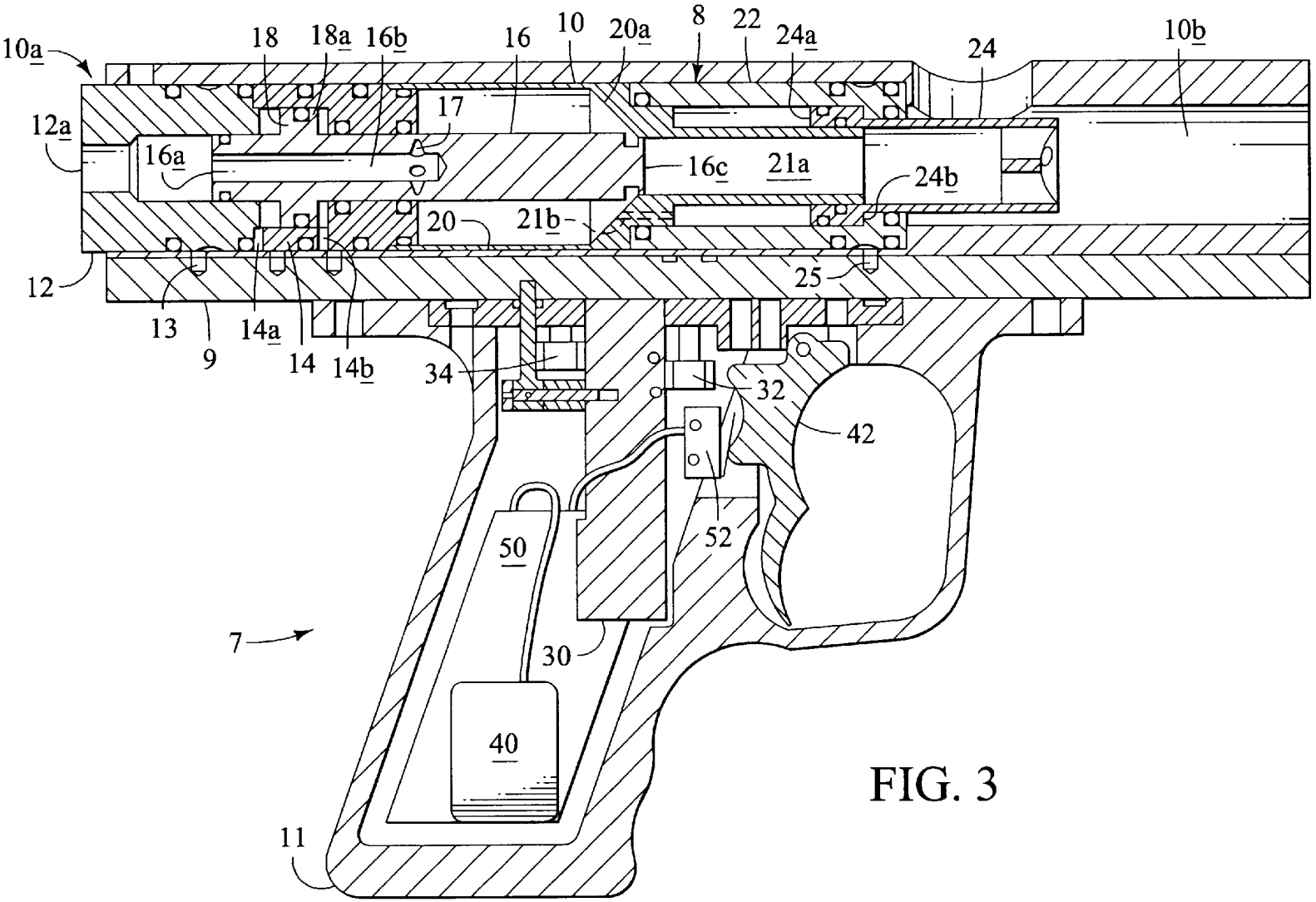
FIG. 3 is a cross-sectional side view of a paintball gun constructed according to another embodiment of the present invention.
Figure 4:
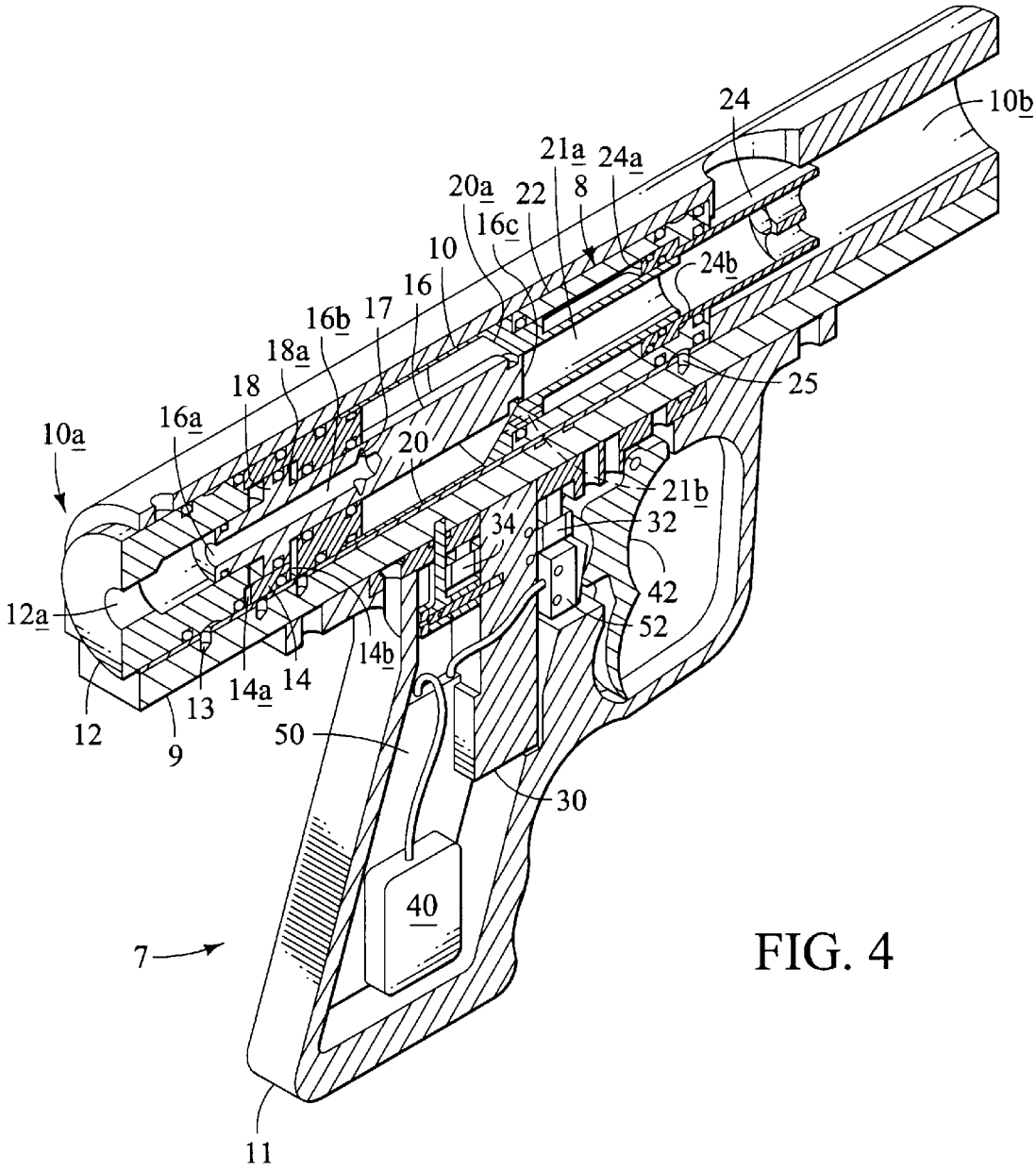
FIG. 4 is a cross-sectional perspective view of the paintball gun of FIG. 3.

Referring now to FIGS. 3 and 4, a paintball gun 7 constructed according to another aspect of this invention includes a housing (or body) 9 having a chamber 10 preferably formed longitudinally therethrough. An in-line assembly 8, such as that described previously, is arranged within the chamber 10 and preferably includes an end cap 12, a valve piston 16, a valve retainer 14, a compressed gas storage area 20, a bolt cylinder 22, and a bolt 24. A receiving port 12*a* in the end cap 12 is arranged near a rearward end 10*a* of the bore 10 to receive a regulated supply of compressed gas from a compressed gas source. The end cap 12 further includes a port arranged to supply a portion of this gas to a control valve 30 though a corresponding port 13 in the gun body 9.

In this particular embodiment, the control valve 30 is an electro-pneumatic four-way solenoid valve (such as that available from the Parker Hannifin Corporation) with one of the output ports plugged. The other output port 34 is selectively pressurized or vented, as desired. When pressurized, the output port 34 receives compressed gas from the input port 32. A three-way solenoid valve or other control valve could also be used. The control valve 30 is preferably at least partially located within a trigger/grip frame 11 along with a circuit board 50 and a power source 40.

A rearward end 16*a* of the valve piston 16 is located within the end cap 12 and receives compressed gas therefrom. The valve piston 16 contains a passageway 16*b* that selectively directs compressed gas from the end cap 12 into the compressed gas storage area 20 through ports 17 in the valve piston 16. A valve actuator 18 of the valve piston 16 is moveably retained in a valve retainer 14. The valve piston 16 is capable of longitudinal sliding movement between a forward and a rearward position. In the forward position, the forward end (the plug) 16*c* of the valve piston 16 is seated within a releasing port 21*a* of the compressed gas storage area 20. The gas storage area 20 receives compressed gas through the valve piston 16 when the plug 16*c* is in its seated position. When the valve is actuated, however, the ports 17 of the valve 16 are withdrawn into the valve retainer 14 and the flow of compressed gas from the end cap 12 to the storage area 20 is substantially cut off. Furthermore, when the valve is actuated, the plug 16*c* releases the compressed gas from the storage area 20 through the gas release port 21*a*.

Ports 14*a*, 14*b* are arranged through the valve retainer 14 on each side of the valve actuator 18. The port 14*a* on the rearward end of the actuator 18 vents gas to ambient pressure. The port 14*b* on the forward side of the actuator 18, on the other hand, communicates with the output port 34 of the control valve 30 to selectively receive or vent pressurized gas.

Compressed gas from the compressed gas storage area 20 is directed into a bolt cylinder 22 through a port 21*b* formed through a forward end 20*a* of the gas storage area 20. A bolt 24 is retained within the bolt cylinder 22 and is capable of movement between an open position, in which loading of a paintball is permitted, and a closed position, in which loading is prevented. A port 25 arranged near the forward end of the bolt cylinder 22 communicates with an output port 34 of the electro-pneumatic valve 30 to receive or vent pressurized gas.

The operation of this embodiment of the invention will now be described with reference to FIGS. 3 and 4. When compressed gas is supplied to the gun 7 through the end cap 12, it contacts the first surface of the valve piston 16 and drives the valve piston 16 into a closed position. The valve plug 16*c* is thereby seated within the gas releasing port 21*a* of the compressed gas storage area 20. A portion of the compressed gas supplied to the end cap 12 is directed through port 13 to an input port 32 of the electro-pneumatic valve 30. Compressed gas is also directed through the passageway 16*b* in the center of the valve piston 16 to the compressed gas storage area 20. Compressed gas from the compressed gas storage area 20 then travels through the port 21*b* at the forward end 20*a* of the storage area 20 into the rearward portion of the bolt cylinder 22. The compressed gas in the rearward portion of the bolt cylinder 22 contacts the rearward surface 24*a* of the bolt 24 and drives the bolt 24 forward into its closed position. A paintball is thus loaded into the breech 10*b* and the paintball gun 7 is ready to be fired.

When the trigger 42 is pulled, it contacts and actuates a microswitch 52 that transmits an electronic signal to a circuit board 50. The circuit board 50 then sends a pulse (or a series of pulses, depending on the firing mode) to actuate the electro-pneumatic valve 30. When actuated, the electro-pneumatic valve 30 directs compressed gas to the forward end 18*a* of the valve actuator 18. Because the second surface area of the valve actuator 18 is greater than the first surface area of the valve piston 16, the valve opens, unseating the plug 16*c* from the gas releasing port 21*a* of the compressed gas storage area 20. At the same time, the ports 17 through the valve piston 16 are pulled into the valve retainer 14 to preferably reduce or substantially cut off the flow of compressed gas into the compressed gas storage area 20. The compressed gas within the gas storage area 20 is released through the gas releasing port 21*a,* through the bolt 24, into the breech 10*b* and into contact with the paintball, thereby launching the paintball.

The forward end of the bolt cylinder 22 also receives compressed gas from the electro-pneumatic valve 30 when actuated. When the electro-pneumatic valve 30 is actuated, the compressed gas in the storage chamber 20 is released, relieving the pressure from the back surface 24*a* of the bolt 24. At the same time, pressure is applied to the front surface 24*b* of the bolt 24, driving the bolt 24 rearwards into its open position. In this position, another paintball is permitted to load into the breech 10*b* of the gun. At the end of the electronic pulse, the electro-pneumatic valve 30 is de-actuated, causing the port 14*b* in front of the valve actuator 18 and the port 25 in front of the bolt 24 to vent the pressurized gas from their respective areas to ambient. As this happens, the force on the valve actuator 18 decreases below that applied to the first surface area of the valve piston 16, causing the valve to close. The gas storage area 20 therefore repressurizes, further directing pressurized gas to the rearward portion 24*a* of the bolt 24, and causing the bolt 24 to close.

In an alternative construction, the forward end 24*b* of the bolt 24 could be configured having a surface area smaller than that of the rearward end 24*a* thereof. In this arrangement, gas of a selected pressure could be constantly supplied to the forward end 24*b* of the bolt. Gas applied to the rearward end 24*a* of the bolt 24 from the compressed gas storage area would also be at the selected pressure. In this configuration, as the compressed gas storage area 20 releases gas, the pressure in the storage area 20 and, hence, in the rearward portion of the bolt cylinder 22 drops. The constant pressure applied to the front end of the bolt cylinder 22 thereby forces the bolt 24 rearward, allowing a paintball to seat within the breech 10*b* of the marker.

At the end of the electronic pulse, the electro-pneumatic valve 30 is de-actuated, causing the port 14*b* in front of the valve actuator 18 to vent the pressurized gas to ambient. As this happens, the force on the rearward surface areas of the valve piston 16 increases above that on the forward surface 18*a* of the valve actuator 18, causing the valve 16 to close and the compressed gas storage area 20 to repressurize. When the gas storage area 20 repressurizes, gas is again communicated to the rearward portion 24*a* of the bolt 24. Because of the area differential between the rearward and forward bolt surfaces, the force of the compressed gas on the rearward portion 24*a* of the bolt 24 is greater than the force of compressed gas on the forward portion 24*b* of the bolt 24, causing the bolt 24 to return to its closed position. The marker 7 is then ready for a subsequent firing sequence.

As an additional benefit to the foregoing design, the ram and the bolt of this embodiment can be formed in the same longitudinal assembly. Conventional electronic guns have had separate ram and bolt assemblies, requiring substantially more space in the paintball gun. This design provides the ability to reduce the overall gun size to about half the size, or less, of conventional electro-pneumatic markers.

Having described and illustrated the principles of the invention through the descriptions of various preferred embodiments thereof, it will be readily apparent to those skilled in the art that the invention can be modified in arrangement and detail without departing from such principles. The claims should be interpreted to cover all such variations and modifications.

What is claimed is:

1. An electro-pneumatic paintball gun comprising:

a housing;

a chamber located within said housing;

a pneumatic assembly disposed within said chamber, said pneumatic assembly comprising a firing valve, a compressed gas storage area, and a bolt, wherein the bolt is configured to be disposed in a closed position before a launching sequence is initiated; and an electro-pneumatic valve configured to actuate the firing valve.

2. An electro-pneumatic paintball gun comprising:

a housing;

a chamber located within said housing;

a pneumatic assembly disposed within said chamber, said pneumatic assembly comprising a firing valve, a compressed gas storage area, and a bolt; and an electro-pneumatic valve configured to actuate the firing valve, wherein the firing valve is configured to be actuated by selectively supplying compressed gas to a second surface area, said second surface area being larger than an opposing first surface area, wherein the first surface area receives a constant supply of compressed gas.

3. An electro-pneumatic paintball gun comprising:

a housing;

a chamber located within said housing;

a pneumatic assembly disposed within said chamber, said pneumatic assembly comprising a firing valve, a compressed gas storage area, and a bolt, wherein a rearward surface area of the bolt is larger than a forward surface area of the bolt, and wherein compressed gas supplied to the rearward surface area of the bolt causes the bolt to close by overcoming a force provided by the compressed gas on the forward surface area of the bolt; and an electro-pneumatic valve configured to actuate the firing valve.

4. An electro-pneumatic paintball gun comprising:

a housing;

a chamber located within said housing;

a pneumatic assembly disposed within said chamber, said pneumatic assembly comprising a firing valve, a compressed gas storage area, and a bolt; and an electro-pneumatic valve configured to actuate the firing valve, wherein the firing valve is configured having a second surface area larger than a first surface area, wherein the first surface area is configured to continuously receive a supply of compressed gas while the gun is pressurized, and wherein said second surface area is configured to selectively receive a supply of compressed gas from the electro-pneumatic valve to operate the firing valve by overcoming a force created by the compressed gas on the first surface area.

5. An electro-pneumatic paintball gun according to claim 4, wherein the first surface area is a rearward surface area and wherein the second surface area is a forward surface area.

6. An electro-pneumatic paintball gun comprising:

a housing;

a chamber located within said housing;

a pneumatic assembly disposed within said chamber, said pneumatic assembly comprising a firing valve, a compressed gas storage area, and a bolt, wherein the bolt comprises a first surface area larger than a second surface area, wherein the second surface area is configured to continuously receive a supply of compressed gas while the gun is pressurized, and wherein the first surface area is configured to receive a supply of compressed gas to operate the bolt by overcoming a force of the compressed gas on the second surface area; and an electro-pneumatic valve configured to actuate the firing valve.

7. An electro-pneumatic paintball gun according to claim 6, wherein the first surface area is a rearward surface area and wherein the second surface area is a forward surface area.

8. An electro-pneumatic paintball gun comprising:

a substantially longitudinally arranged chamber disposed through a housing of said paintball gun from a rearward end to a breech end;

an in-line pneumatic assembly located within said chamber, said in-line pneumatic assembly comprising a firing valve, a compressed gas storage chamber, and a bolt assembly arranged together in a substantially contiguous assembly housing; and an electro-pneumatic valve configured to actuate the firing valve, wherein said firing valve comprises a first surface area and a second surface area, wherein said first surface area is smaller than the second surface area, and wherein said electro-pneumatic valve is configured to selectively supply compressed gas to the second surface area to actuate the firing valve.

9. An electro-pneumatic paintball gun according to claim 8, wherein said first surface area is configured to continuously be exposed to compressed gas while the paintball gun is pressurized.

10. An electro-pneumatic paintball gun comprising:

a substantially longitudinally arranged chamber disposed through a housing of said paintball gun from a rearward end to a breech end;

an in-line pneumatic assembly located within said chamber, said in-line pneumatic assembly comprising a firing valve, a compressed gas storage chamber, and a bolt assembly arranged together in a substantially contiguous assembly housing, wherein said bolt assembly comprises a bolt cylinder and a bolt, wherein said bolt comprises a first surface area and a second surface area, and wherein said second surface area is smaller than said first surface area; and an electro-pneumatic valve configured to actuate the firing valve.

11. An electro-pneumatic paintball gun according to claim 10, wherein said second surface area is configured to continuously receive a supply of compressed gas while the gun is pressurized and wherein the first surface area is configured to receive a supply of compressed gas to close the bolt.

* * * * *